US005103207A

United States Patent [19]

Kerr et al.

[11] Patent Number: 5,103,207

[45] Date of Patent: Apr. 7, 1992

[54] TAUT WIRE SENSING APPARATUS

[75] Inventors: Reginald J. Kerr, British Columbia; Malcolm Saubolle, Ontario, both of Canada

[73] Assignee: Hitek-Protek Systems Incorporated, Toronto, Canada

[21] Appl. No.: 511,622

[22] Filed: Apr. 20, 1990

[30] Foreign Application Priority Data

Oct. 20, 1989 [CA] Canada ..... 2001172

[51] Int. Cl.[5] ..... G08B 13/12

[52] U.S. Cl. ..... 340/541; 340/565; 340/566; 340/666

[58] Field of Search ..... 340/541, 666, 566, 565

[56] References Cited

U.S. PATENT DOCUMENTS

| | | | |
|---|---|---|---|
| 3,502,303 | 10/1968 | Bishop | 256/48 |
| 4,190,796 | 2/1980 | Ishii | 73/719 |
| 4,240,288 | 12/1980 | D'Antonio et al. | 338/5 |
| 4,367,459 | 1/1983 | Amir | 340/541 |
| 4,500,873 | 2/1985 | Porat | 340/515 |
| 4,527,150 | 7/1985 | Porat | 340/541 |
| 4,533,906 | 8/1985 | Amir | 340/541 |
| 4,643,400 | 2/1987 | Porat | 256/52 |
| 4,683,356 | 8/1987 | Stoler | 200/61.93 |
| 4,829,287 | 5/1989 | Kerr et al. | 340/541 |

FOREIGN PATENT DOCUMENTS 967259 5/1975 Canada .

OTHER PUBLICATIONS

Information sheet of Vindicator Corporation for a "Locator TW-3000 Taut Wire Fence Alarm".

*Primary Examiner*—Glen R. Swann, III

*Attorney, Agent, or Firm*—Barrigar & Oyen

[57] ABSTRACT

A sensor post has a hollow interior and a semi-rigid surface which flexes in response to an applied force. Sensor bars are mounted to the semi-rigid surface in a cantilevered fashion, and include an intermediate electrically insulated section located inside the interior of the sensor post. The sensor element mounting means is rigidly mounted to a portion of the sensor post which remains essentially stationary during an intrusive event. Sensing elements are made of a flexible semi-conductive sensing material, whose resistance increases when the material is stretched, and are mounted so as to straddle an electrically insulated section of the sensor bars. A signal analysis means detects an increase in the resistance of the sensing elements and generates an alarm. A wire guiding device uses a separator bar shaped into a zig-zag configuration which is provided with a series of apertures forming an axial channel, and a locking rod dimensioned for insertion into the axial channel formed in the separator bar, thereby entrapping the taut wires.

20 Claims, 8 Drawing Sheets

TAUT WIRE SENSING APPARATUS

FIELD OF THE INVENTION

This invention relates to a sensing apparatus for sensing intrusions of a taut wire security fence.

BACKGROUND OF THE INVENTION

Known taut wire security fences typically consist of a plurality of detection zones, with each detection zone comprising a pair of spaced anchor posts, a plurality of taut wires tensioned between the anchor posts by anchoring means, and a sensor post located between the anchor posts having mounted thereon a multiplicity of sensors, each of which is coupled to a taut wire. An inherent limitation of this type of known fence is that it is relatively insensitive to intrusions which occur close to the anchor post, i.e. such fences have a "dead zone" associated with each anchor post.

This problem is overcome by the taut wire security fence disclosed in U.S. Pat. No. 4,829,287, (Kerr et al), granted to the assignee of this application. The fence disclosed by Kerr et al comprises a plurality of detector posts, each of which includes anchor/sensor means which both anchor the taut wite under tension and act as intrusion sensors. Kerr et al also disclose the use of a partially conductive elastic sensing element, whose resistance decreases with an increase in pressure. This sensing element is used in conjunction with a sensor bar mechanism which, when subjected to a change in lateral tension of a taut wire, compresses the sensing element. This type of sensing mechanism possesses a number of advantages over other prior art sensors, but the non-linear behaviour of the sensing element necessitates the use of sophisticated signal processing electronics.

Another problem with some prior art systems is that they typically utilize a plurality of wire guiding devices comprising a helical coil and a rod. These devices have a major disadvantage, in that they can be removed from the system without triggering an alarm by slowly rotating the coil in an upward direction.

SUMMARY OF THE INVENTION

The present invention is directed to an imporoved sensing apparatus for use with a security fence including a plurality of tensioned taut wires, which overcomes the disadvantages of the prior art. The subject sensing apparatus comprises a sensor post adapted to be rigidly anchored to the ground, a plurality of sensor bars mounted to the sensor post in a cantilevered fashion, a sensor element mounting board mounted inside the sensor post, sensor elemeents straddling the sensor bars, and signal analyzing means.

In a preferred embodiment, the sensor post has a back surface, side surfaces, a front surface with a series of aperatures therein, and a hollow interior. A plurality of sensor bars are mounted to the inside face of the back surface of the sensor post in a cantilevered fashion so as to extend through the hollow interior of the sensor post and the apertures in the front surface thereof. The sensor bars each have a free end extending outside the sensor post, the free end being provided with wire attachment means for attaching thereto a taut wire, and an intermediate electrically insulated portion located in the interior of the sensor post. The sensor element mounting board is mounted inside the interior of the sensor post to the front surface thereof. The sensor element mounting board is provided with a series of apertures in alignment with a series of apertures in the front surface of the sensor post for receiving therethrough the sensor bars. At least one sensing element is mounted on the sensor element mounting board so as to bear against the electrically insulated portion of the sensor bar. The sensing elements are made from a material whose resistance increase when it is stretched. The signal analyzing means is operatively coupled to the sensing element to generate an electrical output signal correlatable with the resistance of the sensing element. The back surface of the sensor post acts like a torsion spring when a force is applied to the sensor bar, whereas the surface of the sensor post to which the sensor mounting board is attached remains essentially stationary. Accordingly, in response to an applied force transmitted to the sensor bar by a taut wire, the cantilevered sensor bar moves relative to the sensor element mounting board, thereby stretching the sensing element.

The present invention is also directed to a wire guiding device for locking the taut wires into a pre-selected parallel relationship, while permitting free longitudinal movement of each wire.

BRIEF DESCRIPTION OF THE DRAWINGS

The invention will now be described, by way of example only, reference to the accompanying drawings, wherein.

FIG. *7a* is a side elevational view of the preferred embodiment of the wire guiding device of the subject invention.

FIGS. *7b* and *7c* are side elevational views of alternative embodiments of the subject wire guiding device.

Figure 8:
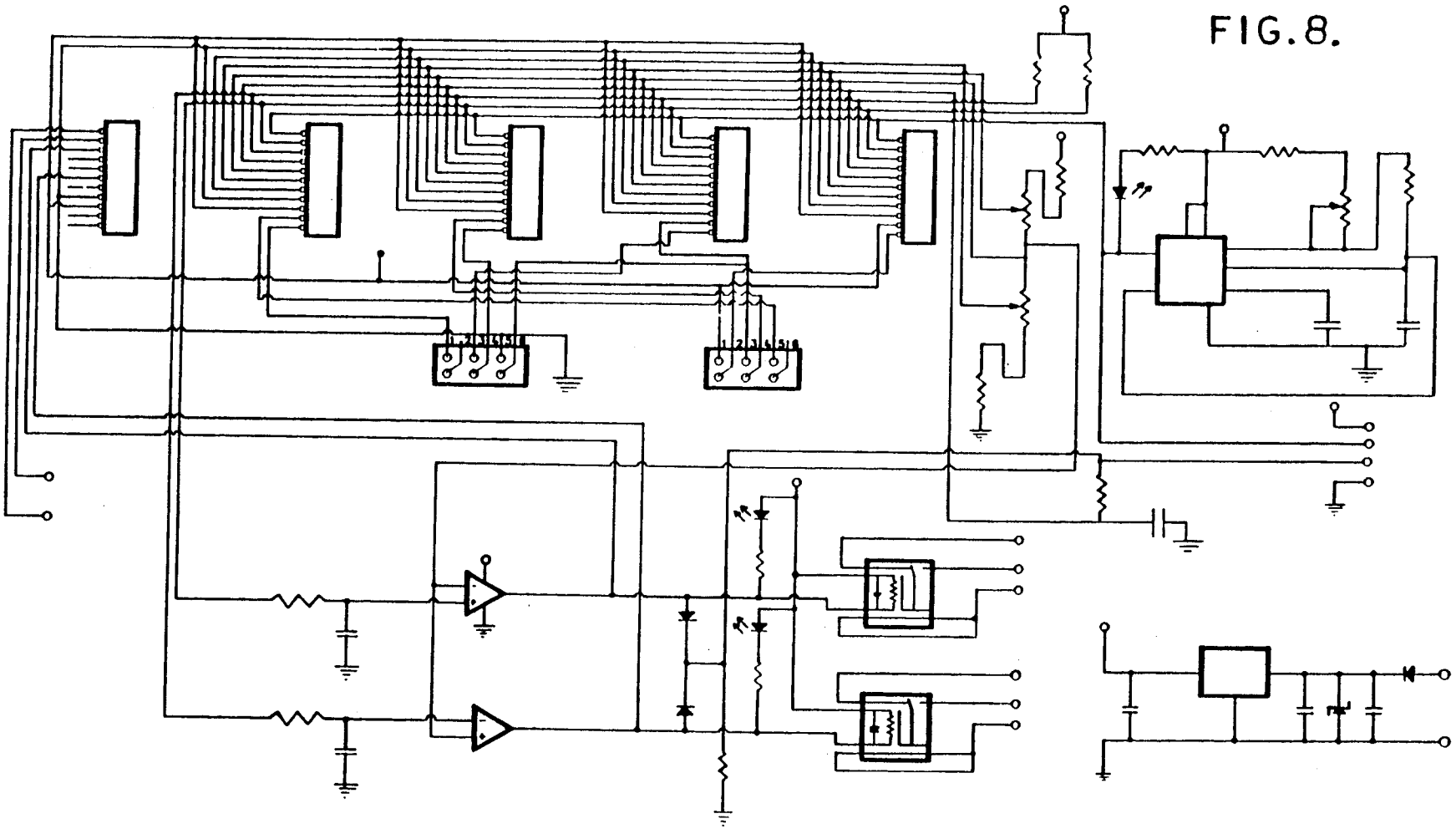
Figure 9:
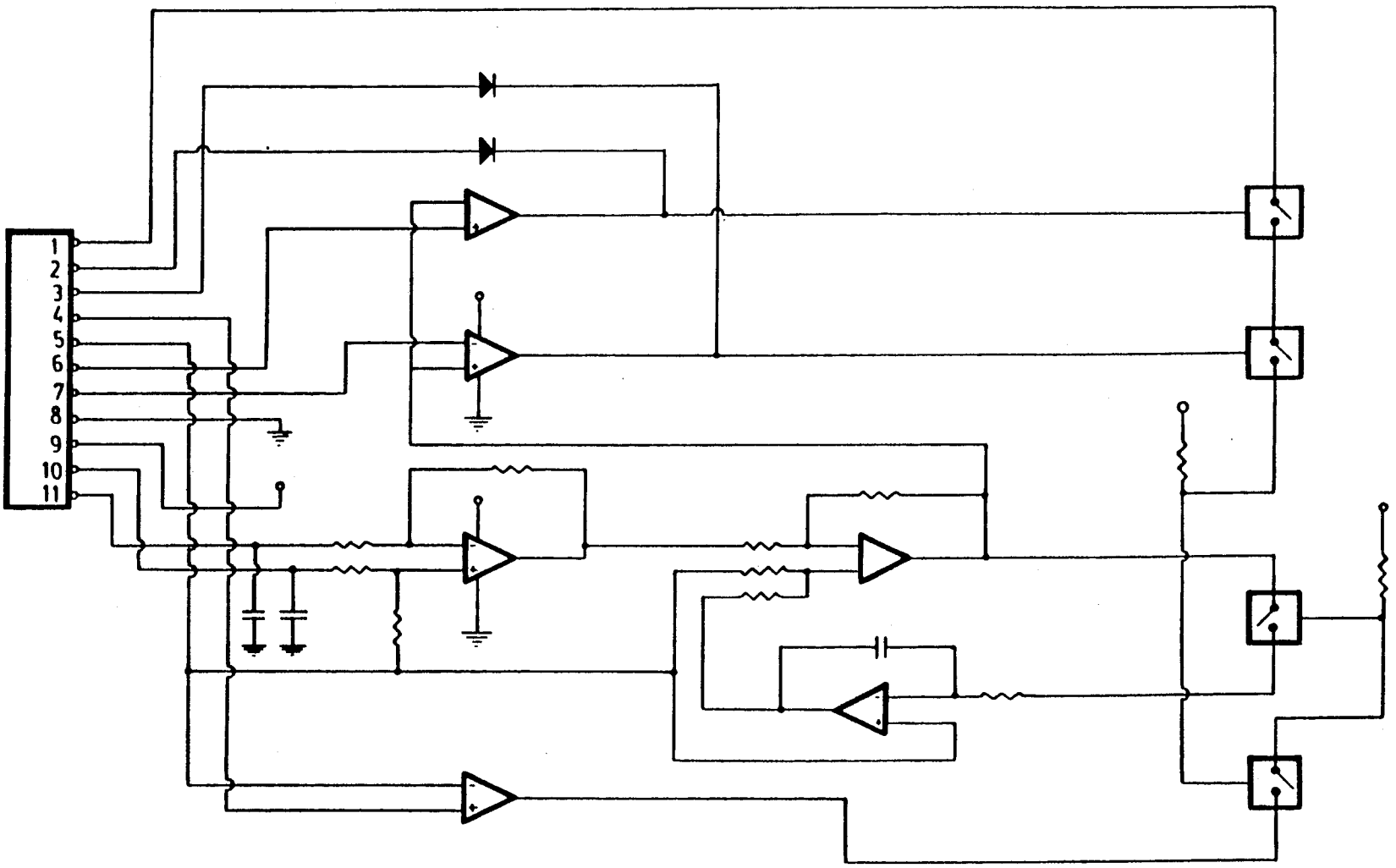

FIGS. 8 and 9 are circuit diagrams of the presently preferred embodiment of the analysis electronics of the subject sensing apparatus.

DETAILED DESCRIPTION OF THE PREFERRED EMBODIMENTS

Figure 1:
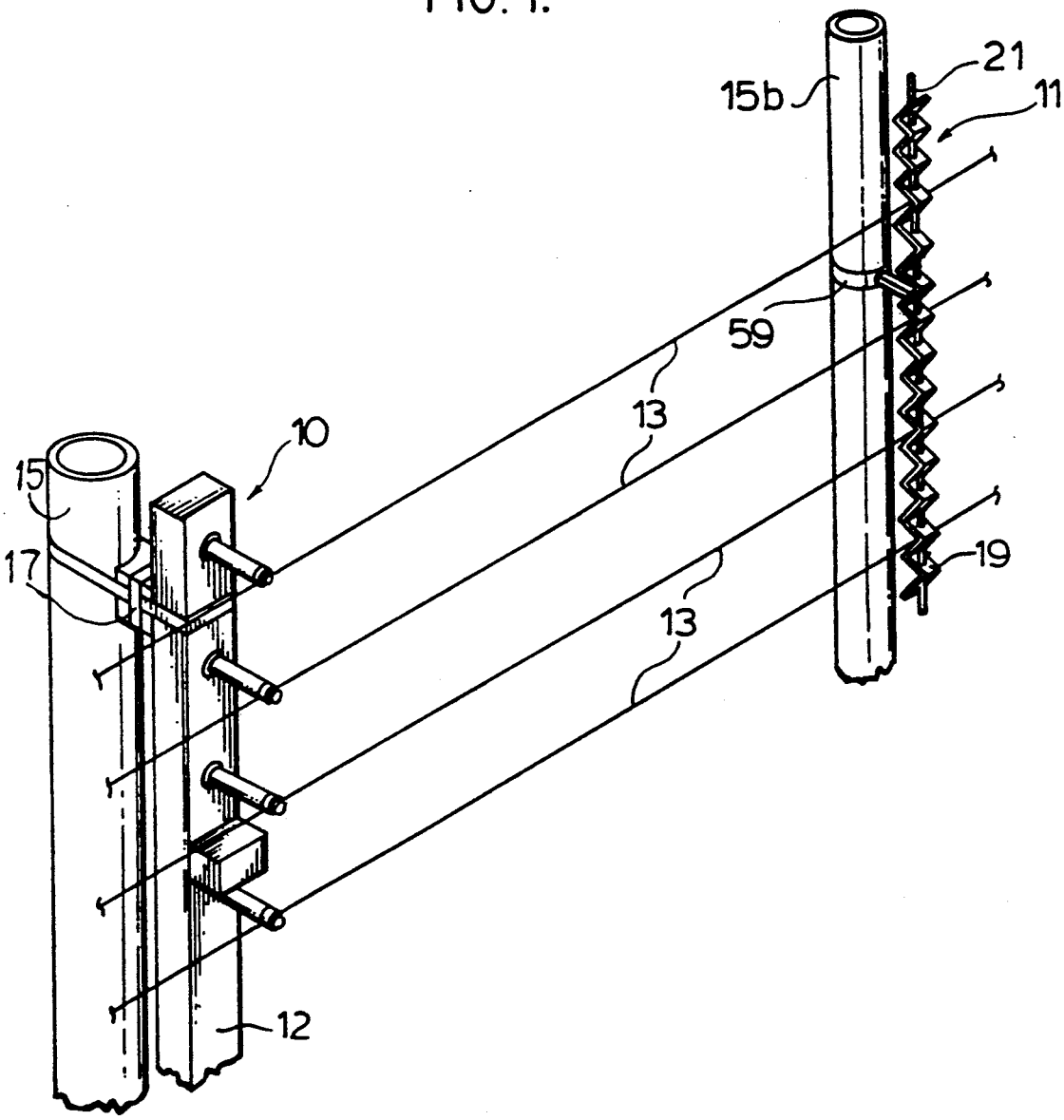
FIG. 1 is a perspective view of preferred embodiments of the sensing apparatus and wire guiding device of the subject invention.

FIG. 1 illustrates sensing apparatus 10 and wire guiding device 11 of the ssubject invention, shown mounted in place as part of a taut wire fence system utilizing spaced parallel taut wires 13, and fence post 15*a*. Sensor post 12 is rigidly secured to fence post 15*a* by a clamps 17. Wire guiding device 11 comprises an elongated folded sheet of metal 19 secured to fence post 15*b*, having aligned apertures through which is inserted a rod 21.

Figure 3:
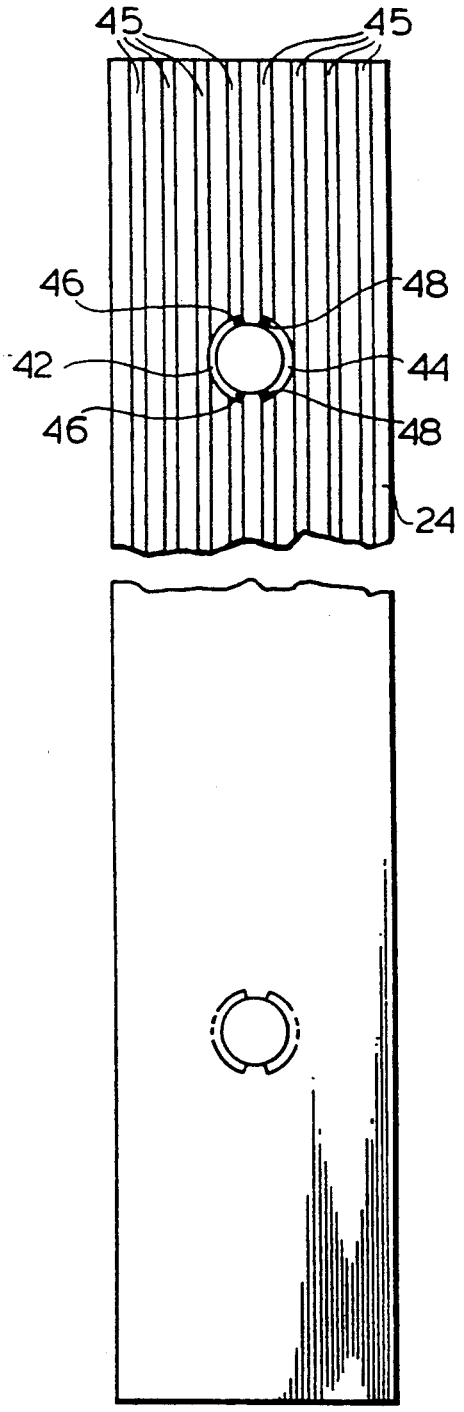
FIG. 3 is a front view of the control board of the sensing apparatus shown in FIG. 2.
Figure 2:
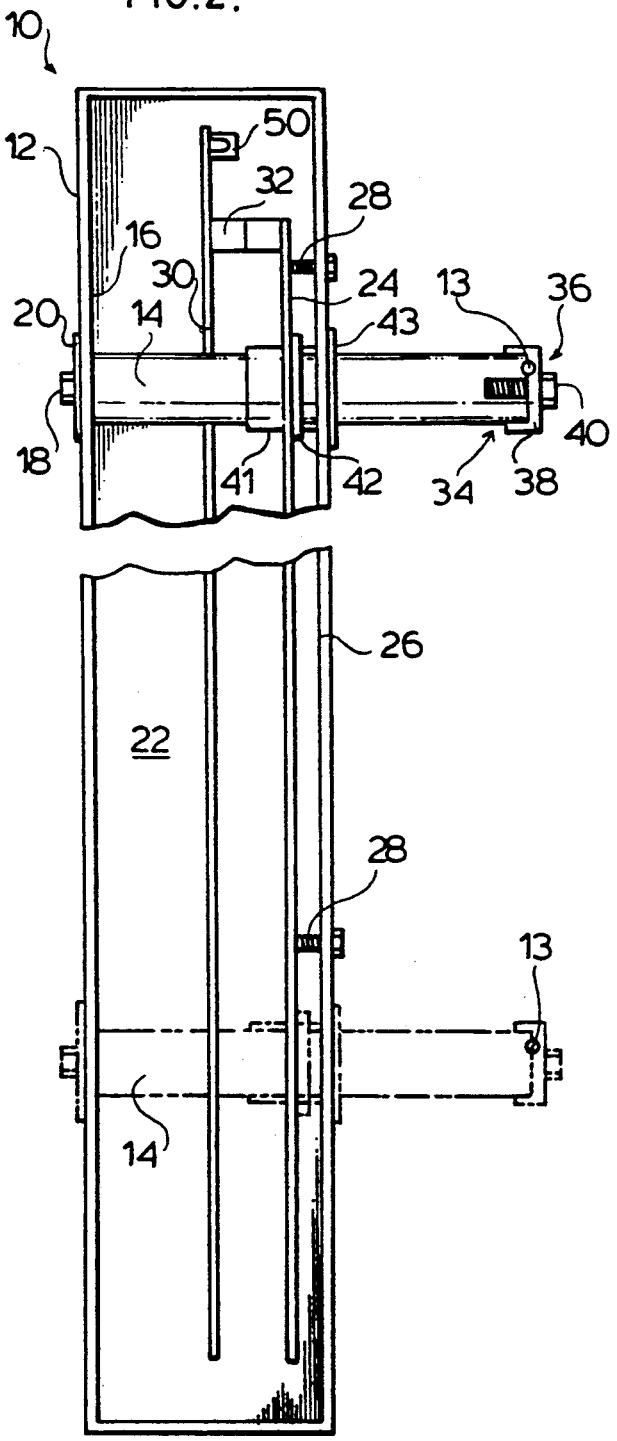
FIG. 2 is a sectional side view of a preferred embodiment of the sensing apparatus of the present invention.

FIG. 2 depicts sensing apparatus 10, comprising a hollow post 12 to which is mounted a plurality of sensor bars 14, each of which is attached to the inside face of semi-rigid back surface 16 of post 12 in a cantilevered fashion by bolt 18 and washer 20. Situated inside the hollow interior 22 of sensor post 12 and running the length thereof is sensor element mounting board 24, which is mounted to the front surface 26 of post 12 by riv-nuts and bolts 28 or other suitable fastening means. Sensor element mounting board 24 preferably takes the form of a printed circuit board. Control printed circuit board 30 is also mounted inside sensor post 12, and is connected to sensor element mounting board 24 by means of terminal blocks 32. Each sensor bar 14 extends thorugh aligned apertures in control board 30, sensor element mounting board 24 and front face 26 of post 12. The free ends 34 of sensor bars 14 extend outside front face 26 and have mounted thereon taut wire attachment means 36 for attaching thereto a taut wire 13, which means preferably comprise clip 38 and bolt 40. A pair of sensor elements 42, 44 are mounted onto sensor element mounting board 24 around the periphery of each aperture therein by pins 46, 48 so as to be tensioned against the sides of sensor bar 14 (FIG. 3). Sensor pin insulating sleeve 41 covers sensor bar 14 at the points of contact with sensor elements 42, 44, so as to electrically insulate sensor elements 42, 44 from sensor bar 14. Dust covers 43 mounted on sensor bars 14 cover up the apertures in the front face 26 of post 12.

Sensor elements 42, 44 are made of a partially conductive rubber whose resistance increases when stretched. Sensor elements 42, 44 preferably take the form of soild tubes of rubber about $\frac{1}{8}$ inch in diameter and about $\frac{3}{4}$ of an inch long. Sensor post 12 is preferably an aluminum post $\frac{1}{8}$ inch thick having a square or rectangular cross-section. Sensor bar 14 is preferably a round aluminium rod about $\frac{5}{8}$ of an inch in diameter. Insulating sleeve 41 is made from a thin plastic or other suitable insulating material.

Referring now to FIG. 3, sensor element mounting means 24 preferably takes the form of a long, two inch wide printed circuit board having parallel tracks 45 for transmitting electrical signals. Sensing elements 42, 44 are each mounted across gaps in tracks 45.

When a force is applied to the free end of sensor bar 14 by taut wire 13, an area of the semi-rigid surface 16 of post 12 around the point of attachment of each sensor bar 14 flexes, or acts like a torsion spring, causing sensor bar to pivot in the direction of the applied force. However, at the same time, the front surface 26 of sensor post 12 remains essentially stationary, because post 12 is rigidly anchored to fence post 15*a* by clamps 17. As well, sensor element mounting board 24, to which are attached sensor elements 42, 44, also remains essentially stationary, since mounting board 24 is mounted to the essentially stationary front face 26. As a result, when sensor bar 14 pivot in the direction of the applied force, either left sensor element 42 or right sensor element 44 is stretched, resulting in a charge in resistence of the sensor element which is stretched.

In a preferred embodiment of the invention, each sensor post 12 contains 14 sensor bars. Preferably, the sensing elements of adjacent sensor bars are coupled together, in a modified wheatstone bridge configuration to be described below. Typically, the sensing element associated with the five top sensor bars form the top wheatstone bridge configuration, the sensing elements associated with the five middle sensing bars form the middle wheatstone bridge configuration, and the sensing elements associated with the bottom four sensor bars form the middle wheatstone bridge configuration. Sensor element mounting board 24 is preferably a printed circuit board having eight tracks 45, three tracks on each side of the sensor for relaying the two outputs of each bridge to the top of the board, and two tracks, one on each side of the sensor bars, for supplying power to the wheatstone bridges.

Figure 4:
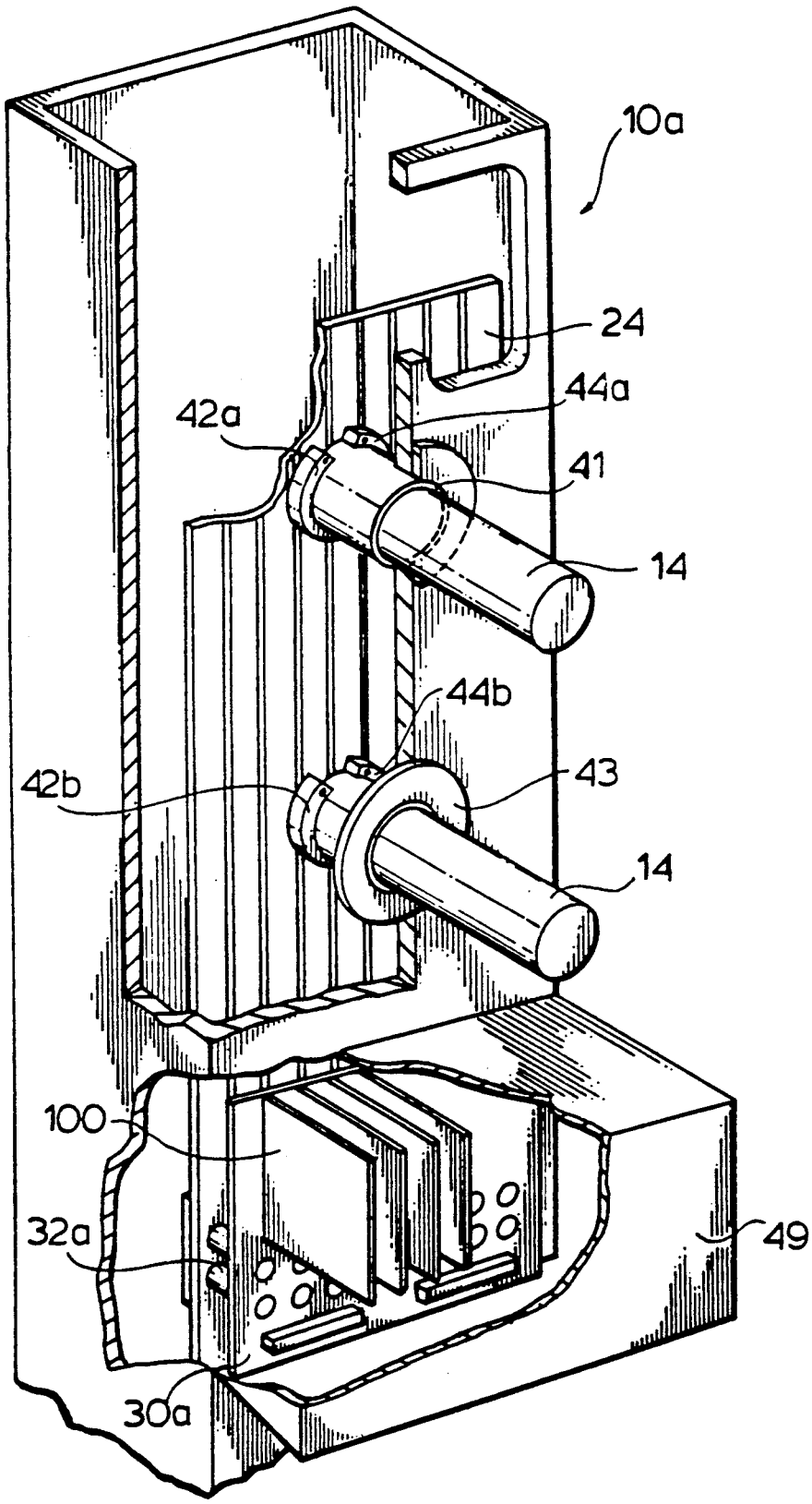
FIG. 4 is a partially cut away perspective view of the presently perferred embodiment of the sensing apparatus of the subject invention.

FIG. 4 illustrates a presently preferred embodiment of the sensing apparatus of the subject invention, referred to generally as 10A, in which the control board takes the form of a small control board 30*a* mounted within control housing 49, by set-offs 32*a*.

Figure 5:
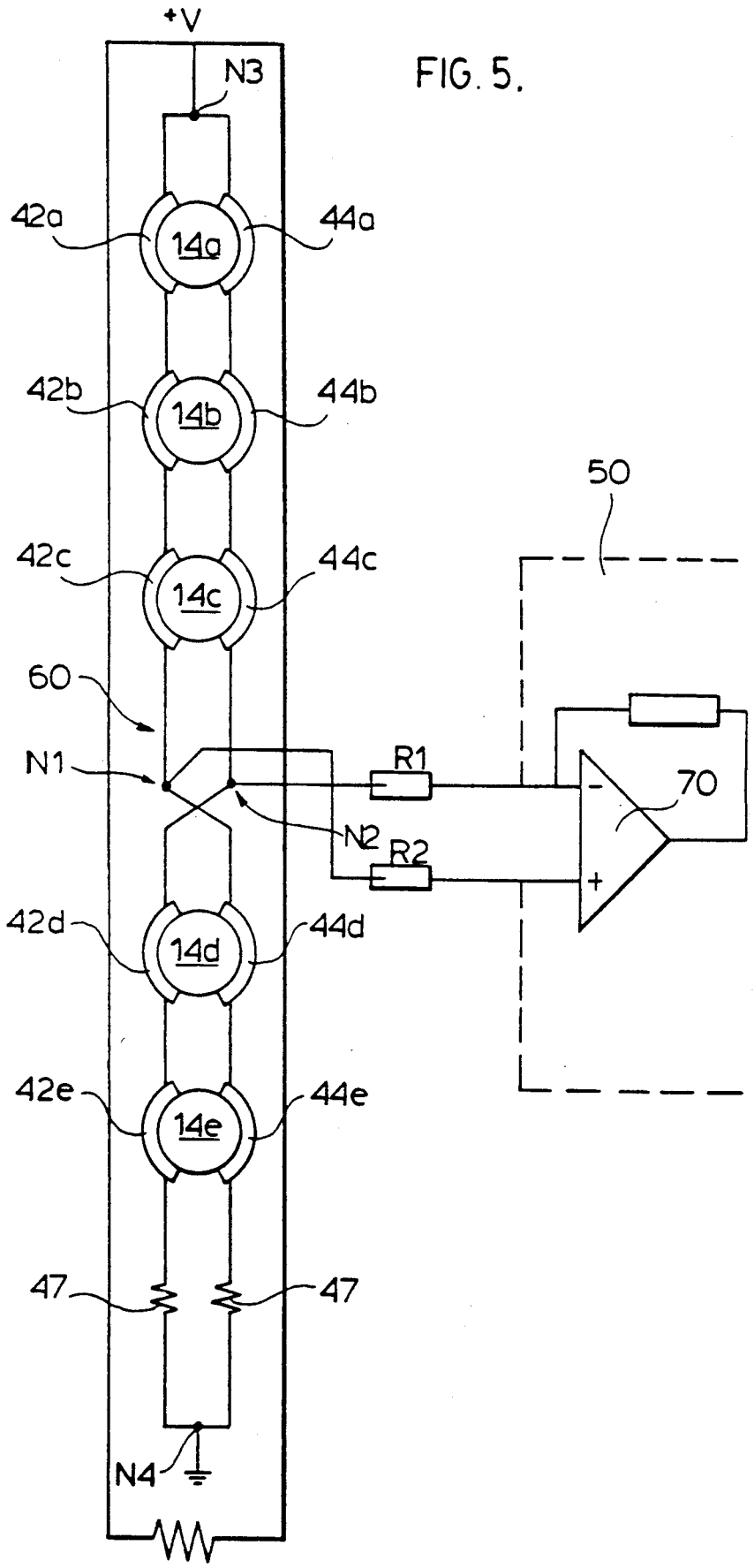
FIG. 5 is a diagramatic view of a portion of the signal analyzing means of the subject invention.

FIG. 5 illustrates in diagramatic form a typical wheatstone bridge connection. Sensing elements 42*a*, 42*b*, 42*c* are connected in series and together form the top left resistor of the wheatstone bridge, and sensing elements 44*a*, 44*b* and 44*c* are connected in series and together form the top right resistor of the bridge. Left sensing elements 42*d* and 42*e*, are connected in series with dummy resistor 47 to form the bottom right resistor of the bridge, and right sensing elements 44*d* and 44*e* are connected together in series with dummy resistor 47 to form the bottom left resistor of the bridge. The wheatstone bridge shown in FIG. 5 differs from the conventional wheatstone bridge in that the positions of the bottom resistors are reversed, thereby avoiding an induced voltage caused by radio frequency interference.

The left node N1 of bridge 60 is connected to the non-inverting input of differential amplifier 70 of analysis electronics 50 through resistor R2, and the right node N2 of bridge 60 is connected to the inverting input of differential amplifier 70 through R1. A positive voltage V is applied to top node N3 and bottom node N4 is grounded. When the bridge is blanced, node N1 and N2 are both at a potential of V/2, making the voltage difference between node N1 and node N2 zero.

When any one of top sensor bars 14*a*, 14*b* or 14*c* is pivoted to the left, one of sensing elements 42*a*, 42*b* or 42*c* is stretched, increasing its resistance. This increase in resistance causes the voltage at left node N1 to go negative below the reference voltage V/2. And, since this voltage is inputted into the non-inverting input of differential amplifier 70, the output of differential amplifier 70 also goes negative. When any one of top sensor bars 14*a*, 14*b* or 14*c* is pivoted to the right, one of the sensing elements 44*a*, 44*b* or 44*c* is stretched, increasing its resistance. This increase in resistance results in the voltage at right node N2 going negative, and since this voltage is inputted into the inverting input of differential amplifier 70, the output of differential amplifier 70 goes positive.

When either of the bottom sensor bars 14*d* or 14*e* is pivoted to the left, the voltage at right node N2 goes positive, resulting in the ouput of differential amplifier 70 going negative. When either of the bottom sensor bars 14*d* or 14*e* is pivoted to the right, the voltage at left node N1 goes positive, resulting in the output of differential amplifier 70 going negative. Therefore, when any one of the sensor bars 42*a* through 42*e* are moved to the left, the output of differential amplifier 70 goes negative below V/2, and when any one of the sensor bars 14*a* through 14*e* is moved to the right, the output of differential amplifier 70 goes positive above V/2.

Figure 6:
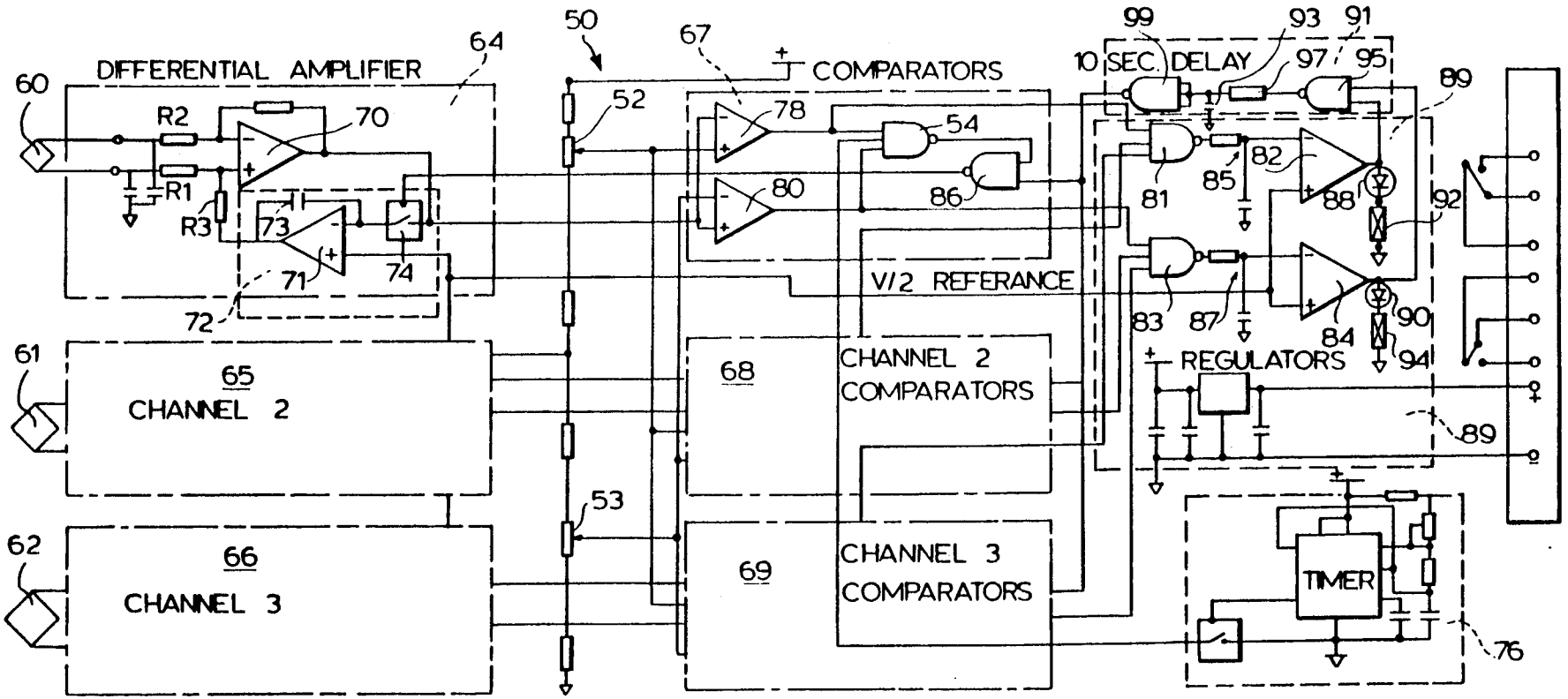
FIG. 6 is a circuit diagram of a preferred embodiment of the analysis electronics of the subject invention.
Figure 7A:
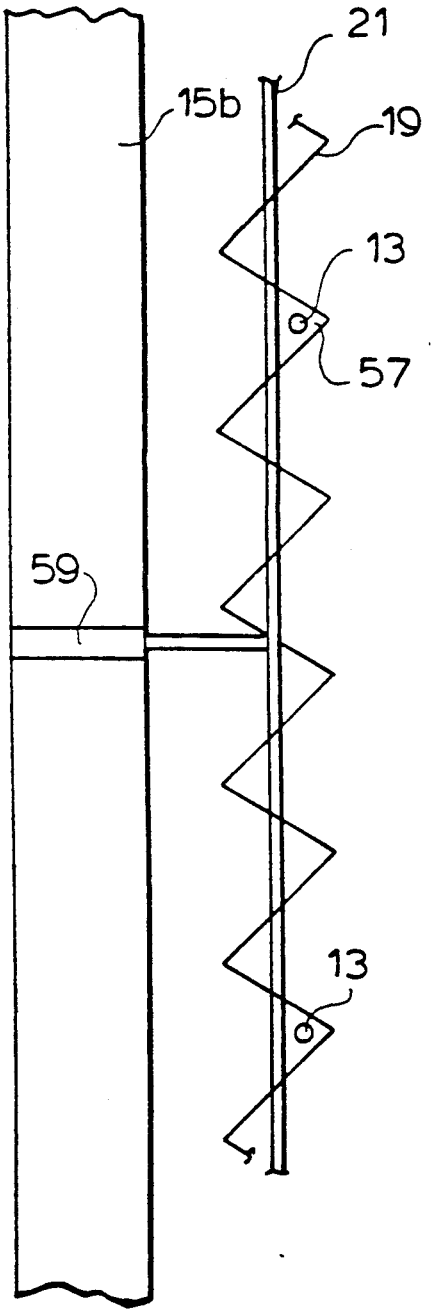
Figure 7B:
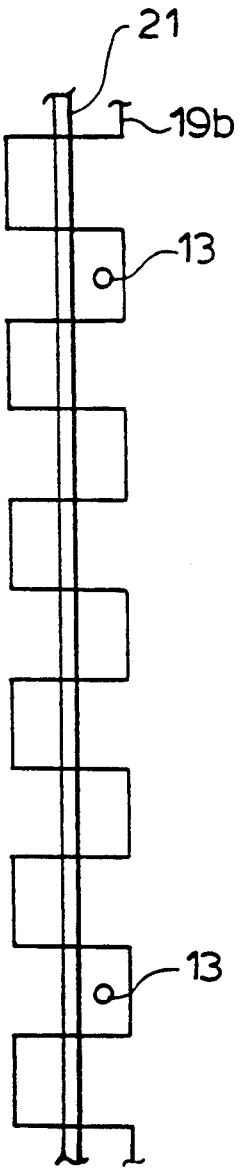
Figure 7C:
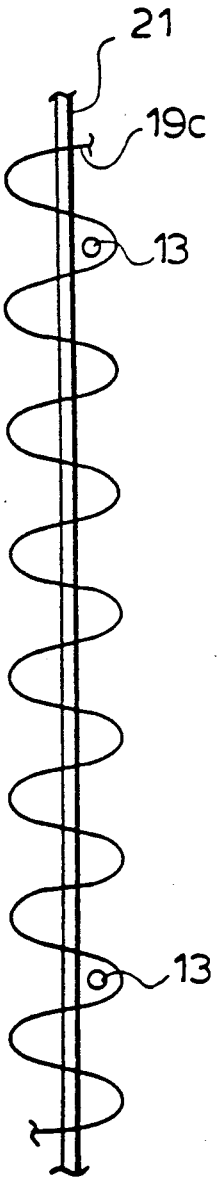

Referring now to FIG. 6, analysis electronics 50 comprises three channels, each of which comprises a differential amplifier section and a comparator section, one channel for processing the signals from each of the three wheatstone bridge configurations in each detector post, and alarm circuitry which is common to all of the three wheatstone bridge configurations. The signals from top wheatstone bridge 60 are fed into differential amplifier section 64 and analyzed by comparator section 67. The signals from middle wheatstone bridge 61 are fed into differential amplifier section 65 and analyzed by comparator section 68. The signals from botton wheatstone bridge 62 are fed into differential amplifier section 66 and analyzed by comparator section 69. The outputs of comparator sections 67, 68 and 69 are fed into alarm generating circuitry 89.

Alarm circuitry 50 is designed both to detect intrusive events and to distinguish intrusive events from non-intrusive events caused by changing environmental conditions and other false alarms. In particular, alarm circuitry 50 includes circuit means for correcting the imbalance of the wheatstone bridges caused by the following factors:

1. A constant imbalance of the bridge caused by the tension of the taut wires being uneven either left or right;
2.. A long term imbalance of the bridge caused by large temperature changes;
3. A long term imbalance of the bridge due to the shifting of anchor posts caused by settling of the grounds;
4. A long term drift caused by settling of the taut wires after installation;
5. An imbalance of the bridge caused by settling of the taut wires in a new position after a violent intrusion;
6. A temporary imbalance of the bridge caused by bursts of RF interference;
7. A temporary imbalance of the bridge caused by transient false alarm signals, resulting from presons banging the taut wires, strong winds, birds, rain and other evironmental factors.

The make up and operation of a typical channel of analysis electronics 50 will now be described in detail. Referring now to the top channel of analysis electronics 50, comprising differential amplifier section 64 and comparator section 67, the output of differential amplifier 70 is inputted into both the inverting input of the comparator 78 and the non-inverting input of comparator 80. The non-inverting input of comparator 78 is set at a voltage increment $\Delta V$ above $V/2$ (the reference voltage) by potentiometer 52, and the inverting input comparator 80 is set at a voltage increment $\Delta V$ below $V/2$ by potentiometer 53, to form a voltage window, $V/2 \pm \Delta V$. At steady state, when no intrusive event is occurring, the output of differential amplifier 70 is $V/2$. Thus, the steady state voltage inputted to the inverting input of comparator 78 $V/2$, which is less than the top window voltage, namely $V/2+\Delta V$, applied to the non-inverting input of comparator 78. Consequently, the output voltage of comparator 78 is positive, at steady state. Similarly, the output voltage of comparator 80 is also positive at steady state, since the voltage applied to the non-inverting input thereof, namely $V/2$, is greater than the bottom window voltage applied to the inverting input thereof, namely $V/2-\Delta V$.

If one of the sensor bars 14*a–c* in the top section of the sensor post 10 is pivoted to the right, wheatstone bridge 60 is placed in a state of imbalance, causing the output of differential amplifier 70 to go positive above $V/2$. If the output of differential amplifier 70 exceeds $V/2+\Delta V$, the top window voltage established by potentiometer 52, the output of comparator 78 goes negative, because the output of differential amplifier 70 is inputted into the inverting input of comparator 78. The output of comparator 78 is connected to one input of three input NAND gate 81 and to one input of three input NAND gate 54. In response to receiving a negative signal from comparator 78, NAND gate 81 generates a positive signal which is filtered by low pass filter 85 which both delays the signal and eliminates transient signals which might be caused by someone banging the fence or creating some other non-intrusive vibrations. The signal from filter 85 is inputted into the inverting input of relay driver 82, which is an operational amplifier configured as a power switch. The output of relay drive 82 is coupled to LED 88 and relay 92. Relay driver 82 generates signal which activates LED 88 and causes relay 92, which is normally on, to turn off. Turning off relay 92 generates an alarm. NAND gate 54 disables clock 76, in a manner to be discribed below.

If any one of the sensor bars associated with wheatstone bridge 60 is pivoted to the left, bridge 60 is imbalanced, causing the output of differential amplifier 70 to go negative below $V/2$. As mentioned above, the output of differential amplifier 70 is applied to the non-inverting input of comparator 80, as well as the inverting input of comparator 78. If the signal inputted into the non-inverting input of comparator 80 is less than the bottom window voltage $V/2-\Delta V$, comparator 80 generates a negative signal. Meanwhile, the output of comparator 78 remains positive. The output comparator 80 is inputted into NAND gate 83 and NAND gate 54. NAND gate 83 generates an output signal which is filtered by low pass passive filter 87, and then is inputted into the inverting input of relay driver 84, which like relay driver 82 is an operational amplifier which is configured as a power switch. Relay driver 84 generates an output signal which activates LED 90 and opens left relay 94. LED 90 acts as a visual indication of an intrusion. Relay 94 creates an alarm.

Relays 92, 94 and LEDS 88, 90 are normally "on" in steady state, and are switched to "off" when an intrusive event occurs. This configuration is part of a fail safe set up which ensures that an alarm will be generated if, for example, an intruder cuts the alarm wires.

Long term drift is compensated for by drift compensation circuit means including store 72 and clock 76. The configuration and operation of this drift compensation circuit means will now be described.

The output of differential amplifier 70 is connected to store 72 through analog switch 74. Store 72 comprises operational amplifier 71 and capacitor 73. The non-inverting input of operational amplifier 71 is maintained at the reference voltage of $V/2$. When switch 74 is closed, the output of differential amplifier 70 is inputted into the inverting input of operational amplifier 71. The gate of analog switch 74 is controlled by timer 76 in a manner to be described below. The output of operational amplifier 71 is inputted into the non-inverting input differential amplifier 70 through a resistor R3. Operational amplifier 74 functions to "top up"capacitor 73, as follows. When analog switch 74 is closed, operational amplifier 71 acts as a comparator, which compares the output of differential amplifier 70 to the reference voltage $V/2$, and provides feedback to differential amplifier 70. If the output of differential amplifier 70 is negative below the reference signal, operational amplifier 71 generates a positive signal, which is inputted into the non-inverting input of differential amplifier 70, which in turn increases the output of differential amplifier 70 back towards the reference voltage. Similarly, if the output of differential amplifier 70 is positive above the reference signal, operational amplifier 71 generates a negative signal, since the output of differential amplifier 70 is inputted into the inverting input of operational amplifier 71, and this negative output signal of operational amplifier 71 is inputted into the non-inverting input of differential amplifier 70, which in turn reduces the output of differential amplifier 70 back towards the reference voltage. Thus store 72 acts as a closed servo loop, which brings the output of differential amplifier 70 back to the reference voltage value, when analog switch 74 is closed. As a result, when the servo loop of store 72 is closed, the output of differential amplifier 70 remains at V/2, and no alarm can be generated. This reduces the long term drift.

Analog switch 74 is pulsed on and off by clock 76. Clock 76 has a short on-time, e.g. 100 milliseconds, and a long off-time, e.g. 3 seconds. The period of clock 76 is adjusted to ensure than any long term imbalance in the bridge 60 is adjusted out when the clock is active. The steady state output of the clock is negative. Every 3 seconds or so, clock 76 generates a positive pulse, which is inputted into NAND gate 54. At steady state when no intrusive events are occuring, the other two inputs of NAND gate 54 are also positive. When all three of the inputs of NAND gate 54 are positive, NAND gate 54 generates a negative pulse, which is inputtd into NAND gate 86. Since the other input of NAND gate 86 is positive in steady state, the output of NAND gate 86 is negative, in steady state, However, when the negative pulse from NAND gate 54 generated by the clock pulse arrives at NAND gate 86, NAND gate 86 generates a positive pulse which drives the gate of analog switch 74, causing the switch 74 to close, which in turn closes the servo loop of store 72.

When an intrusive event occurs, the clock 76 is disabled as follows. As mentioned above, the output of comparators 78 and 80 are each inputted into one of the inputs of NAND gate 54. When an intrusive event occurs, the outputs of either comparator 78 or comparator 80 goes negative, causing one of the inputs of NAND gate 54 to go negative. Since all three inputs of NAND gate 54 must be positive in order for NAND gate 54 to generate a negative output signal needed to generate a positive pulse from NAND gate 86, when one of the inputs of NAND gate 54 is negative, analog switch 74 cannot be closed and the store 72 can not be updated, by clock 76. Thus clock 76 is disabled by comparator 78 or comparator 80, while an intrusive event is occuring.

In the ordinary case, after the occurance of an intrusive event, the output of differential amplifier 70 drops back into the voltage window, causing the output of both comparators 78 and 80 to return to a positive steady state value, and enabling the clock 76, which in turn activates store 72 to return the output of differential amplifier to the reference voltage. However, if an intrusive event is particularly violent, it is possible that the rubber sensing elements 42, 44 may be stretched to such an extent that it takes such sensing elements some time to return to their steady state resistance value. Or, if a taut wire is cut, one of the sensing element will remain stretched until the wire is repaired. In both cases, it is necessary to return the output of differential amplifier 70 to within the window.

Accordingly, analysis circuitry 50 also comprises circuit compensation means 91, which includes NAND gate 95, an RC delay circuit comprising capacitor 93 and resisitor 97, and NAND gate 99. When either right relay 92 or left relay 94 goes off, a signal from relay driver 82 or relay driver 84 is transmitted to the input of NAND gate 95, causing the output of NAND gate 95 to go positive. This output signal is delayed while capacitor 93 charges up through resistor 97. The output of this delay circuit is inputted into NAND gate 99, which has all of its inputs tied together and therefore acts as an inverter. The output of NAND gate 99, which is negative in steady state, becomes positive, and is inputted into NAND gate 86, forcing NAND gate 86 to go positive and closing analog switch 74, regardless of whether or not there is a clock pulse present. As a result, store 72 is activated, closing servo loop and a returning the output differential amplifier 72 to the reference voltage.

Referring now to FIGS. *7a–c*, wire guiding device 11 locks taut wires 13 into a spaced parallel relationship, while allowing lateral movement. Wire guiding device 11 comprises separator bar 19 and locking rod 21. Separator bar 19 is an elongated strip of sheet material shaped into a basic zig-zag configuration. The actual shape of the zig-zag can be varied from a sinusoidal through a square to a saw-tooth wave. Separator bar 19 is provided with a series of apertures, one in each section thereof, which are aligned along the neutral axis of the separator bar, so as to form an axial channel, to enable insertion therethrough of locking rod 21. The basic effect is the creation of a series of loops 57 in which taut wires 13 can be entrapped by locking rod 21. Separator bar 19 is applied to fence post **15*b* once the taut wires are tensioned in place. Locking rod 21 is then inserted into the aforesaid channel, thereby trapping taut wires 13 in outside loops 57. Wire guiding device 11 is secured to post 15*b* by means of clamp and S-bracket 59**.

As shown in FIG. *7a*, separator bar is shaped in a saw-tooth configuration to minimize the amount of material required and to facilitate production thereof. FIG. *7b*illustrates an alternative embodiment in which the separator bar **19*b*** is a square wave, and FIG. *7c* depicts a further alternative embodiment in which the separator bar **19*c* takes the form of a sine-wave. Wire guiding device 11 cannot be disabled by slowly twisting sheet 19 upwardly, unlike some prior art wire guiding device comprising a helical coil. Another advantage of wire guiding device 11** is that it enables the taut wires to be accurately spaced from one another, at selected spacings.

In operation, when an intruder applies a force above some minimum value (which depends upon the span and tension of the taut wires) a force is applies to the free end of one of sensor bars 14, causing a portion of back surface 16 around the point of attachment of sensor bar 14 to sensor post 12 to flex. As a result, sensor bar pivots left or right, depending upon the direction of the force, but the rest of sensor post 12, including sensor element mounting board 24, remains essentially stationary. As sensor bar 14 pivots, one of sensing elements 42, 44 tensioned against the side of sensor bar 14 is stretched, increasing its resistance. This increase in resistance imbalances bridge 60, creating an output signal which is inputted into analysis circuitry 50. Analysis electronics 50 determines whether or not this output signal is above or below a preselected range, and if it is, an alarm is generated. If the intrusion is particularly violent, circuit compensation means 91 functions to return analysis circuitry 50 to a steady state condition. Meanwhile, during steady state operations, when no intrusive events occur, the clock 76 and store 72 of analysis electronics 50 electronically compensate for various types of long term drift. Additionally, analysis electronics 50 include means for distinguishing intrusive events from pulse alarms caused by transient signals, comprising low pass filters 85 and 87.

It has been found that movement of the taut wires 13 by about 2-3 inches within a 10 foot span between wire guiding devices 11 will cause sufficient movement of the sensor bars 14 to initiate an alarm.

FIGS. 8 and 9 are circuit diagrams of the presently preferred embodiment of the analysis electronics of the subject invention.

It should be appreciated that while the presently preferred embodiments of the analysis circuitry are primarily in analog form, digital circuitry comprising a microprocessor or discrete logic components could be used to analyze the output from the wheatstone bridges. Also, while in its presently preferred form, the subject invention utilizes wheatstone bridge configurations as a means for processing the signals, other types of configurations could be used, including circuitry for analyzing the output of a single sensing element.

Furthermore, while the preferred embodiment of the sensor post comprises an aluminium post of square or rectangular cross-section, other types of post could be utilized, provided that the sensor post includes both a plate or other means for mounting the sensing elements against the sensor bars which remains essentially stationary during an intrusive event, and a semi-rigid surface or other means for enabling the sensor bars pivot relative to the tensioned sensing elements.

Accordingly, it should be apparent that while the subject invention has been described with reference to various preferred embodiments thereof, many other variation can be made, without departing from spirit of this invention, the scope of which is defined in the appended claims.

We claim:

1. Sensing apparatus for use with a taut wire security fence including a plurality of trip wires, comprising:

(a) a sensor post adapted to be rigidly anchored to the ground, having a hollow interior and a semi-rigid suface which flexes in response to an applied force;

(b) a plurality of sensor bars each having a fixed end mounted to the semi-rigid surface at a pivot point and a free end extending outside the hollow interior of the sensor post, the free end being provided with wire attachment mean for attaching thereto a tensioned trip wire, the sensor bars also including an intermediate electrically insulated section located inside the interior of the sensor post;

(c) sensor element mounting means located inside the interior of the sensor post, the sensor element mounting means being rigidly mounted to a portion of the sensor post which remains essentially stationary during an intrusive event;

(d) a plurality of sensing elements, each of which is composed of a flexible semi-conductive sensing material whose resistance increases when the material is stretched, each of which is mounted on the sensor element mounting means against the side of the electrically insulated section of one of the sensor bars, such that the sensing element stretches when the sensor bar pivots in response to a force applied to the free end thereof; and (e) signal analysis means for detecting the increase in resistance of the sensing elements and for generating an alarm.

2. The sensing apparatus as defined in claim 1, further comprising attachment means for rigidly attaching the sensor post to a fence post anchored into the ground so as to maintain the sensor post essentially stationary, except for a portion of the semi-rigid surface around each pivot point, when a force is applied to the free end of a sensor bar by a change in tension of one of the trip wires caused by an intrusive event.

3. The sensing apparatus as defined in claim 2, wherein the sensor post has a back surface and side surfaces, and a front surface with apertures therein for receiving therethrough the sensor bars.

4. The sensing apparatus as defined in claim 3, wherein the sensor element mounting means comprises a mounting board mounted to the front surface of the sensor post, having apertures therethrough to accommodate the sensor bars, the mounting board being spaced from and parallel to the front surface of the sensor post.

5. The sensing apparatus as defined in claim 4, wherein the sensing elements are mounted to the mounting board adjacent each aperture by pins extending through the ends of the sensing elements.

6. The sensing apparatus as defined in claim 5, wherein a pair of sensing elements are mounted so as to straddle each sensor bar, one of the pair of sensing elements being located to the left of the sensor bar and the other of the pair being located to the right of the sensor bar.

7. The sensing apparatus as defined in claim 6, wherein the sensing elements are stretched against the side of the sensor bars in steady state operation when no intrusive events are occuring.

8. The sensing apparatus as defined in claim 7, wherein the sensing elements comprise a thin, flexible rod-shaped piece of sensing material.

9. The sensing apparatus as defined in claim 4, wherein the mounting board is a printed circuit board which runs the length of the sensor post.

10. The sensing apparatus as defined in claim 3, wherein the fixed ends of the sensor bars are attached to the back surface of the sensor post.

11. The sensing apparatus as defined in claim 3, wherein the sensor post has a square cross-section.

12. The sensing apparatus as defined in claim 1, wherein the sensor elements are connected in a wheatstone bridge circuit.

13. The sensing apparatus as defined in claim 12, wherein the signal analysis means comprises means for comparing the output signal from the wheatstone bridge circuit to an upper window reference signal value and a lower window reference signal value, and means for generating an alarm if the output signal is above the upper window reference signal value or below the lower window reference signal value.

14. The sensing apparatus as defined in claim 13, wherein the signal analysis means comprises amplifier means for amplifying the signal received from the wheatstone bridge circuit and circuit means for compensating for long term drift, comprising feedback means for adjusting the output of the amplifier means to match a reference value, and clock means for periodically activating the feedback means.

15. The sensing apparatus as defined in claim 14, wherein the signal analysis means comprises disable circuit means for disabling the clock means while an intrusive event is occuring.

16. Sensing apparatus for use with a security fence including a series of fence posts anchored into the ground and a plurality of trip wires, comprising:

a sensor post having a back surface, side surfaces, a front surface with a series of apertures therein, and a hollow interior;

anchoring means for rigidly anchoring the sensor post to a fence post;

a plurality of sensor bars mounted to the inside face of the back surface of the sensor in a cantilivered fashion, the sensor bars extending through the hollow interior of the sensor post and the apertures in the front surface thereof, the sensor bars each having a free end extending outside the sensor post, the free end being provided with wire attachment means for attaching thereto a taut wire, the sensor bars also including an elctrically insulated intermediate portion located inside the hollow interior of the sensor post;

a sensor mounting plate mounted inside the hollow interior of the sensor post to the front surface thereof, the mounting plate being spaced from and parallel to the front surface thereof, the mounting plate being provided with a series of apertures in alignment with the series of apertures in the front surface of the sensor post for receiving therethrough the sensor bars;

at least one sensing element mounted on the mounting plate adjacent each plate aperture so as to be positioned against the surface of the sensor bar extending therethrough, wherein the sensing element is made from a material whose resistance increases when it is stretched; and signal analyzing means operatively coupled to the sensing element for generating an electrical output signal correlatable with the resistance of the sensing element;

wherein the back surface of the sensor post acts like a torsion spring when a force is applied to one of the sensor bars, and wherein the anchoring means keep the front surface of the sensor post essentially stationary, whereby in response to the applied force, the cantilivered sensor bar moves relative to the mounting plate, thereby stretching the sensing element.

17. The sensing apparatus as defined in claim 1, wherein the electrically insulated section of the sensor bar is formed by fitting a sleeve of electrically insulating material to an intermediate portion of the sensor bar.

18. The sensing apparatus as defined in claim 12, wherein the wheatstone bridge circuit comprises a top left resistor, a bottom left resistor, a top right resistor and a bottom right resistor electrically connected together in a wheatstone bridge configuration, wherein the sensing elements mounted to the left of a preselected first number of sensor bars are electrically connected in series to form the top left resistor, the sensing elements mounted to the right of the preselected first number of sensor bars are electrically connected in series to form the top right resistor, the sensing elements mounted to the left of a preselected second number of sensor bars are electrically connected in series to form the bottom right resistor, and the sensing elements mounted to the right of the preselected second number of sensor bars are electrically connected in series to form the bottom left resistor.

19. A wire guiding device for use with a security fence including a series of sensor posts anchored to the ground and a plurality of trip wires tensioned therebetween, comprising:

a series of intermediate posts anchored to the ground, at least one of which is placed intermediate between pairs of sensor posts;

a separator bar shaped into a zig-zag configuration and provided with a series of apertures aligned along the longitudinal axis thereof to form a channel along the longitudinal axis of the separator; and a rod dimensioned for insertion in said axial channel and adapted to be coupled to the intermediate post after insertion, thereby forming a series of loops for entrapping therein the trip wires.

20. The wire guiding device of claim 19, wherein the zig-zag configuration takes the form of a saw-tooth wave.

* * * * *

UNITED STATES PATENT AND TRADEMARK OFFICE

CERTIFICATE OF CORRECTION

PATENT NO. : 5,103,207
DATED : April 7, 1992
INVENTOR(S) : Reginald J. Kerr, et al It is certified that error appears in the above-indentified patent and that said Letters Patent is hereby corrected as shown below:

Col. 3, line 40, insert --back-- before "surface".

Col. 5, line 50, insert --is-- after "78".

Col. 6, line 56, delete "74" and insert therefor --71--.

Col. 9, line 46, delete "mean" and insert therefor --means--.

Col. 11, line 7, insert --post-- after "sensor".

Col. 12, line 34, insert --bar-- after "separator".

Signed and Sealed this

Twenty-fourth Day of August, 1993

Bruce Lehman

*Attest:*

BRUCE LEHMAN

*Attesting Officer*

*Commissioner of Patents and Trademarks*